US010787900B2

(12) United States Patent
King et al.

(10) Patent No.: US 10,787,900 B2
(45) Date of Patent: Sep. 29, 2020

(54) DIFFERENTIAL PRESSURE INDICATOR FOR DOWNHOLE ISOLATION VALVE

(71) Applicant: Weatherford Technology Holdings, LLC, Houston, TX (US)

(72) Inventors: Kyle Allen King, Houston, TX (US); Joe Noske, Houston, TX (US); Christopher L. McDowell, New Caney, TX (US); Brian A. Mickens, Humble, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 878 days.

(21) Appl. No.: 14/522,852

(22) Filed: Oct. 24, 2014

(65) Prior Publication Data

US 2015/0144334 A1 May 28, 2015

Related U.S. Application Data

(60) Provisional application No. 61/908,844, filed on Nov. 26, 2013.

(51) Int. Cl.
*E21B 47/06* (2012.01)
*E21B 34/06* (2006.01)
(Continued)

(52) U.S. Cl.
CPC ..... *E21B 47/06* (2013.01); *E21B 34/06* (2013.01); *E21B 34/101* (2013.01); *E21B 47/12* (2013.01); *E21B 2200/05* (2020.05)

(58) Field of Classification Search
CPC .... E21B 2034/005; E21B 47/06; E21B 47/12; E21B 34/06
See application file for complete search history.

(56) References Cited

U.S. PATENT DOCUMENTS 3,249,124 A * 5/1966 Berryman ..... E21B 21/10 137/629
4,161,219 A * 7/1979 Pringle ..... E21B 34/10 166/324
(Continued)

FOREIGN PATENT DOCUMENTS

EP 1356186 B1 10/2003
EP 1980711 A2 10/2008
(Continued)

OTHER PUBLICATIONS

Australian Patent Examination Report dated Sep. 16, 2015, for Australian Application No. 2014268178.
(Continued)

*Primary Examiner* — Cathleen R Hutchins
*Assistant Examiner* — Ronald R Runyan
(74) *Attorney, Agent, or Firm* — Patterson + Sheridan, LLP

(57) ABSTRACT

A differential pressure indicator (DPI) for use with a downhole isolation valve includes a tubular mandrel for assembly as part of a casing string and for receiving a tubular string. The mandrel has a stop shoulder and a piston shoulder. The DPI further includes a tubular housing for assembly as part of the casing string and for receiving the tubular string. The housing is movable relative to the mandrel between an extended position and a retracted position and has a stop shoulder and a piston shoulder. The DPI further includes a hydraulic chamber formed between the piston shoulders and a coupling in communication with the hydraulic chamber and for connection to a sensing line. The housing is movable relative to the mandrel and to the extended position in response to tension exerted on the DPI.

32 Claims, 6 Drawing Sheets

(51) Int. Cl.
*E21B 34/10* (2006.01)
*E21B 47/12* (2012.01)

(56) References Cited

U.S. PATENT DOCUMENTS 4,194,581 A * 3/1980 Walter ..... E21B 4/14 173/64
4,527,600 A * 7/1985 Fisher ..... B67D 7/08 141/4
4,599,906 A * 7/1986 Freud ..... G01F 1/386 73/706
6,152,232 A * 11/2000 Webb ..... E21B 10/64 166/332.4
6,199,629 B1 * 3/2001 Shirk ..... E21B 34/06 166/302
6,644,110 B1 11/2003 Curtis et al.
6,766,703 B1 7/2004 Kluth et al.
7,255,173 B2 * 8/2007 Hosie ..... E21B 21/08 166/250.01
7,350,590 B2 4/2008 Hosie et al.
7,451,809 B2 11/2008 Noske et al.
7,673,689 B2 3/2010 Jackson et al.
7,836,973 B2 11/2010 Belcher et al.
7,878,266 B2 2/2011 Griffin et al.
8,459,619 B2 * 6/2013 Trinh ..... B60G 17/0155 267/64.23
2002/0070028 A1 * 6/2002 Garcia ..... E21B 34/06 166/373
2004/0129424 A1 7/2004 Hosie et al.
2006/0021757 A1 2/2006 Patel
2006/0076149 A1 4/2006 McCalvin
2006/0157282 A1 7/2006 Tilton et al.
2007/0084607 A1 4/2007 Wright et al.
2007/0095546 A1 5/2007 Farquhar et al.
2008/0060846 A1 * 3/2008 Belcher ..... E21B 17/042 175/25
2009/0050373 A1 2/2009 Loretz
2009/0250206 A1 10/2009 Lake et al.
2009/0308607 A1 12/2009 Anyan
2011/0155392 A1 6/2011 Frazier
2011/0232916 A1 9/2011 Maldonado
2011/0240299 A1 10/2011 Vick, Jr. et al.
2012/0067594 A1 3/2012 Noske et al.
2012/0234558 A1 9/2012 Godfrey et al.
2013/0068476 A1 3/2013 Edwards
2013/0092396 A1 4/2013 Webber et al.
2013/0105149 A1 * 5/2013 Williamson, Jr. ..... E21B 34/06 166/250.01
2014/0048331 A1 2/2014 Boutalbi et al.
2014/0202768 A1 * 7/2014 Noske ..... E21B 34/06 175/57
2015/0083494 A1 3/2015 Noske et al.

FOREIGN PATENT DOCUMENTS

EP 2053196 A1 4/2009
GB 2342669 A 4/2000
GB 2424435 A 9/2006
WO 2011110816 A2 9/2011
WO WO 2011110816 A2 * 9/2011 ..... E21B 34/102

OTHER PUBLICATIONS

EPO Office Action dated Dec. 7, 2016, for European Patent Application No. 14194019.7.
EPO Extended European Search Report in related application 14194019.7 dated Jul. 3, 2017.
Partial European Search Report in related applciaiton EP 14194019 dated Mar. 30, 2017.
Canadian Office Action in related applicaiton CA 2,871,925 dated Dec. 8, 2015.
EPO Office Action dated Jul. 4, 2019, for European Application No. 14194019.7.
Brazilian Office Action in related matter BR102014029367 dated Apr. 1, 2020.
European Search Report in related application EP 20156464.8 dated May 28, 2020.

* cited by examiner

DIFFERENTIAL PRESSURE INDICATOR FOR DOWNHOLE ISOLATION VALVE

BACKGROUND OF THE DISCLOSURE

1. Field of the Disclosure

The present disclosure generally relates to a differential pressure indicator for a downhole isolation valve.

2. Description of the Related Art

A wellbore is formed to access hydrocarbon bearing formations, e.g. crude oil and/or natural gas, by the use of drilling. Drilling is accomplished by utilizing a drill bit that is mounted on the end of a drill string. To drill the wellbore, the drill string is rotated by a top drive or rotary table on a surface platform or rig, and/or by a downhole motor mounted towards the lower end of the drill string. After drilling a first segment of the wellbore, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

An isolation valve assembled as part of the casing string may be used to temporarily isolate a formation pressure below the isolation valve such that a drill string, work string, completions string, or wireline may be quickly and safely inserted into or removed from a portion of the wellbore above the isolation valve that is temporarily relieved to atmospheric pressure. Since the pressure above the isolation valve is relieved, the drill/work string can be tripped into the wellbore without wellbore pressure acting to push the string out and tripped out of the wellbore without concern for swabbing the exposed formation.

Before reopening the valve, pressure above the valve is equalized with pressure below the valve in order to avoid damage thereto. The differential pressure across the valve is determined using available known parameters. However, this results in only an estimate of the differential pressure.

SUMMARY OF THE DISCLOSURE

The present disclosure generally relates to a differential pressure indicator for a downhole isolation valve. In one embodiment, a differential pressure indicator (DPI) for use with a downhole isolation valve includes a tubular mandrel for assembly as part of a casing string and for receiving a tubular string. The mandrel has a stop shoulder and a piston shoulder. The DPI further includes a tubular housing for assembly as part of the casing string and for receiving the tubular string. The housing is movable relative to the mandrel between an extended position and a retracted position and has a stop shoulder and a piston shoulder. The DPI further includes a hydraulic chamber formed between the piston shoulders and a coupling in communication with the hydraulic chamber and for connection to a sensing line. The housing is movable relative to the mandrel and to the extended position in response to tension exerted on the DPI.

In another embodiment, a method of constructing a wellbore includes deploying a tubular string into the wellbore through a casing string disposed in the wellbore. The casing string has an isolation valve in a closed position and a hydraulic sensing line extending along the casing string. The method further includes: equalizing pressure across the isolation valve using the sensing line to determine differential pressure across the isolation valve; opening the isolation valve; and lowering the tubular string through the open valve.

In another embodiment, an isolation valve for use in drilling a wellbore includes: a tubular housing for assembly as part of a casing string and for receiving a drill string; a seat disposed in the housing and longitudinally movable relative to the housing; a flapper pivotally connected to the seat between an open position and a closed position; a flow tube longitudinally movable relative to the housing for opening the flapper; a hydraulic chamber formed between the flow tube and the housing and receiving a piston of the flow tube; a hydraulic passage in fluid communication with the chamber and a hydraulic coupling; and a differential pressure indicator (DPI) linked to the seat for responding to force exerted on the seat by the flapper in the closed position.

In another embodiment, an isolation valve for use in drilling a wellbore includes a tubular housing: for assembly as part of a casing string, for receiving a drill string, and having a shoulder formed in an inner surface thereof for receiving the seat. The isolation valve further includes: a seat disposed in the housing and longitudinally movable relative to the housing; a flapper pivotally connected to the seat between an open position and a closed position; a flow tube longitudinally movable relative to the housing for opening the flapper; a hydraulic chamber formed between the flow tube and the housing and receiving a piston of the flow tube; a hydraulic passage in fluid communication with the chamber and a hydraulic coupling; and a differential pressure indicator (DPI) for measuring force exerted on the isolation valve when the flapper is in the closed position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
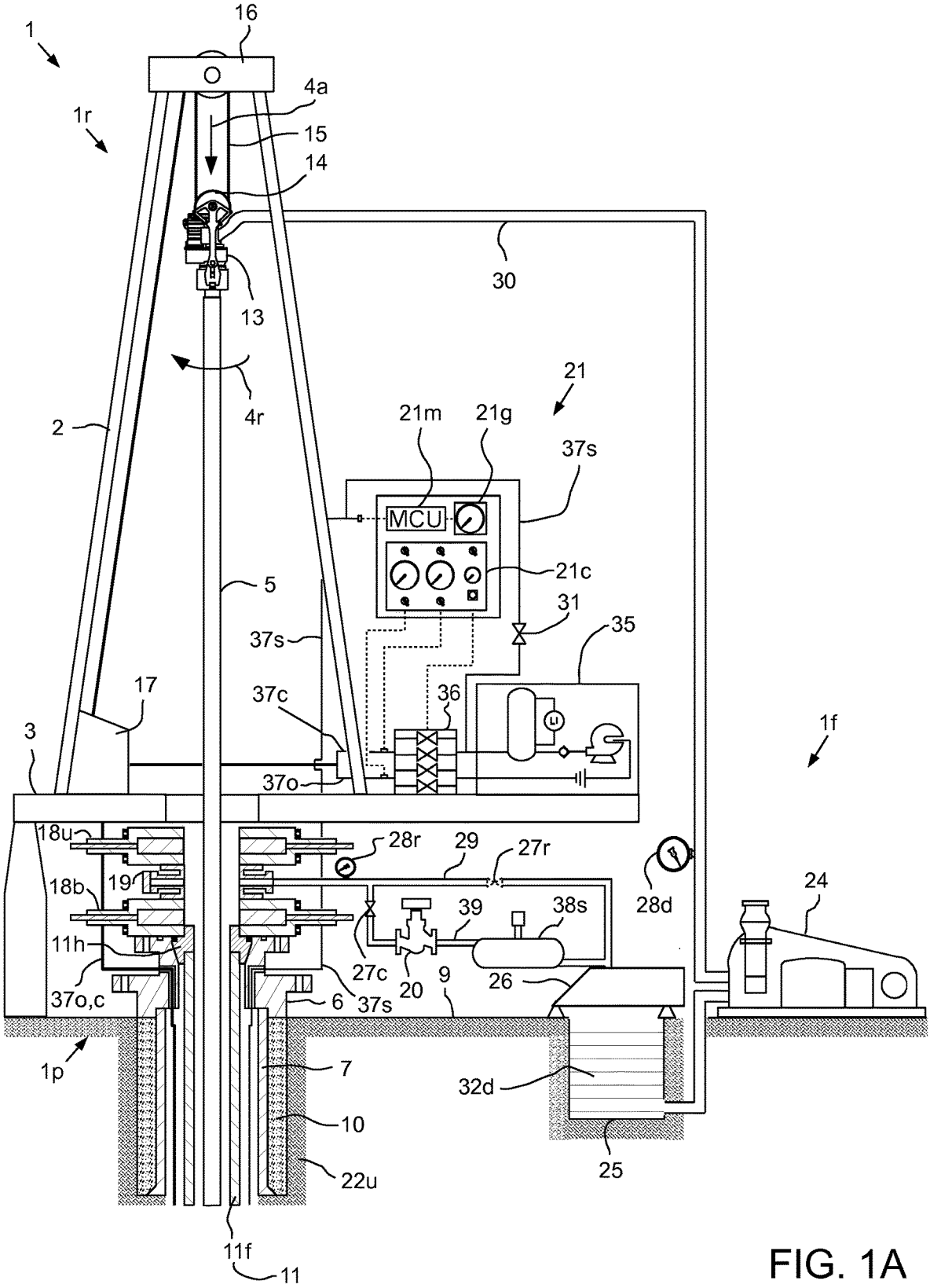
FIGS. 1A-1C illustrate a terrestrial drilling system in a drilling mode, according to one embodiment of the present disclosure.
Figure 1B:
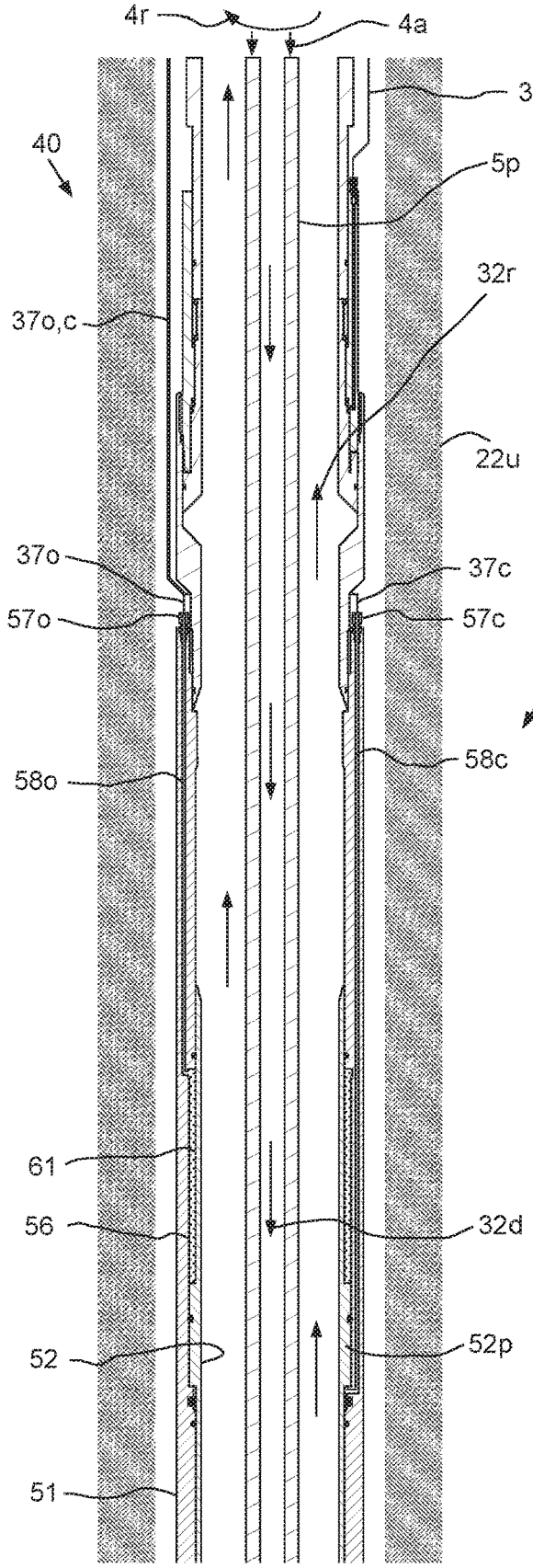
Figure 1C:
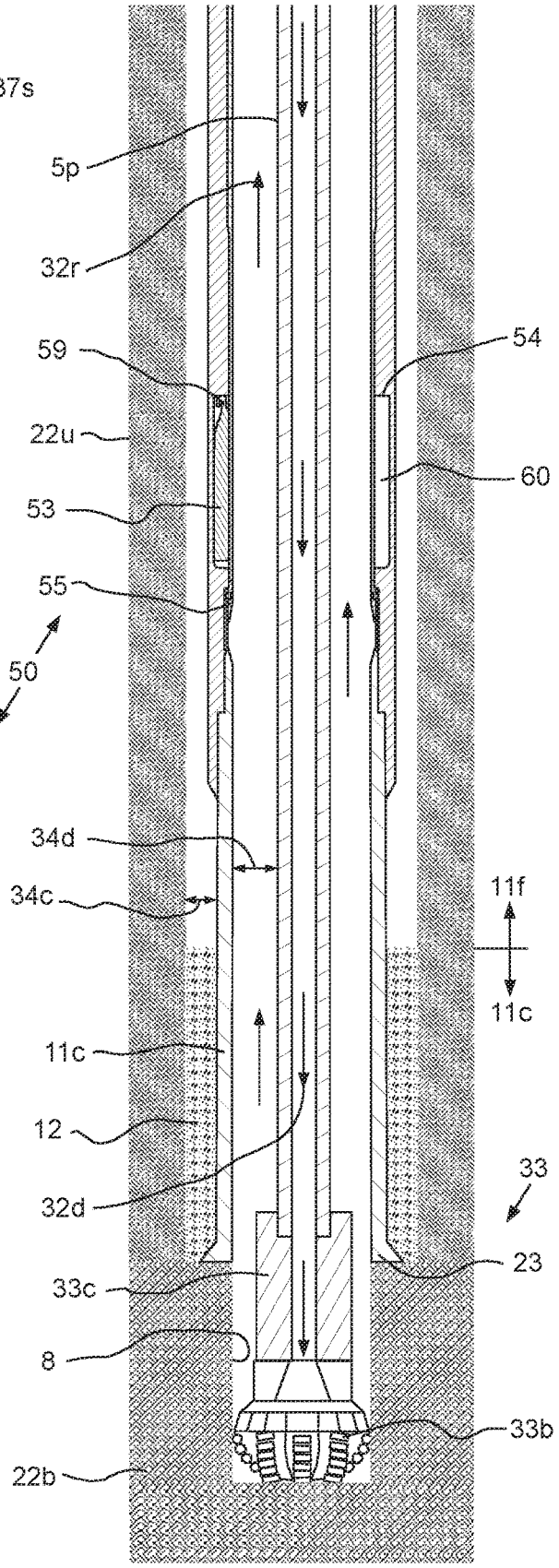

FIGS. 1A-1C illustrate a terrestrial drilling system 1 in a drilling mode, according to one embodiment of the present disclosure. The drilling system 1 may include a drilling rig 1*r*, a fluid handling system 1*f*, a pressure control assembly (PCA) 1*p*, and a drill string 5. The drilling rig 1*r* may include a derrick 2 having a rig floor 3 at its lower end. The rig floor 3 may have an opening through which the drill string 5 extends downwardly into the PCA 1*p*. The drill string 5 may include a bottomhole assembly (BHA) 33 and a conveyor string. The conveyor string may include joints of drill pipe 5*p* connected together, such as by threaded couplings. The BHA 33 may be connected to the conveyor string, such as by threaded couplings, and include a drill bit 33*b* and one or more drill collars 33*c* connected thereto, such as by threaded couplings. The drill bit 33*b* may be rotated 4*r* by a top drive 13 via the conveyor string and/or the BHA 33 may further include a drilling motor (not shown) for rotating the drill bit. The BHA 33 may further include an instrumentation sub (not shown), such as a measurement while drilling (MWD) and/or a logging while drilling (LWD) sub.

An upper end of the drill string 5 may be connected to a quill of the top drive 13. The top drive 13 may include a motor for rotating 4*r* the drill string 5. The top drive motor may be electric or hydraulic. A frame of the top drive 13 may be coupled to a rail (not shown) of the derrick 2 for preventing rotation thereof during rotation of the drill string 5 and allowing for vertical movement of the top drive with a traveling block 14. The frame of the top drive 13 may be suspended from the derrick 2 by the traveling block 14. The traveling block 14 may be supported by wire rope 15 connected at its upper end to a crown block 16. The wire rope 15 may be woven through sheaves of the blocks 14, 16 and extend to drawworks 17 for reeling thereof, thereby raising or lowering 4*a* the traveling block 14 relative to the derrick 2.

The PCA 1*p* may include, one or more blow out preventers (BOPs) 18*u,b*, a flow cross 19, a variable choke valve 20, a control station 21, one or more shutoff valves 27*c,r*, one or more pressure gauges 28*d,r*, a hydraulic power unit (HPU) 35, a hydraulic manifold 36, an auxiliary valve 31, one or more control lines 37*o,c*, a sensing line 37*s*, a choke spool 39, a differential pressure indicator (DPI) 40, and an isolation valve 50. A housing of each BOP 18*u,b* and the flow cross 19 may each be interconnected and/or connected to a wellhead 6, such as by a flanged connection.

The wellhead 6 may be mounted on an outer casing string 7 which has been deployed into a wellbore 8 drilled from a surface 9 of the earth and cemented 10 into the wellbore. An inner casing string 11 has been deployed into the wellbore 8, hung from the wellhead 6, and a portion 11*c* thereof cemented 12 into place. The inner casing string 11 may extend to a depth adjacent a bottom of an upper formation 22*u*. The upper formation 22*u* may be non-productive and a lower formation 22*b* may be a hydrocarbon-bearing reservoir. The inner casing string 11 may include a casing hanger 11*h*, a plurality of casing joints connected together, such as by threaded couplings, the DPI 40, the isolation valve 50, and a guide shoe 23. The inner casing string may have a free portion 11*f* including the hanger 11*h*, a plurality of casing joints, the DPI 40, and the isolation valve 50, and the cemented portion 11*c* including the guide shoe 23 and a plurality of casing joints. A casing annulus 34*c* may be formed between the inner casing string 11 and the outer casing string 7 and between the inner casing string 11 and a portion of the wellbore 8 traversing the upper formation 22*u*. A free portion of the casing annulus 34*c* (adjacent to the respective free portion 11*f*) may be open (free from cement 12).

The sensing line 37*s* may extend from the HPU 35, through the wellhead 6, along an outer surface of the inner casing string 11, and to the DPI 40. The control lines 37*o,c* may extend from the manifold 36, through the wellhead 6, along an outer surface of the inner casing string 11, and to the isolation valve 50. The control lines 37*o,c* and sensing line 37*s* may be fastened to the inner casing string 11 at regular intervals. The control lines 37*o,c* may be bundled together as part of an umbilical.

Alternatively, the sensing line 37*s* may also be bundled with the control lines 37*o,c* as part of the umbilical. Alternatively, instead of the inner casing string, the well may include a liner string hung from a bottom of the outer casing string and cemented into the wellbore and a tie-back casing string hung from the wellhead and having a lower end stabbed into a polished bore receptacle of the liner string and the DPI 40 and isolation valve 50 may be assembled as part of the tie-back casing string. Alternatively, the lower formation 22*b* may be non-productive (e.g., a depleted zone), environmentally sensitive, such as an aquifer, or unstable. Alternatively, the wellbore may be subsea having a wellhead located adjacent to the waterline and the drilling rig may be a located on a platform adjacent the wellhead. Alternatively, a Kelly and rotary table (not shown) may be used instead of the top drive.

The isolation valve 50 may include a tubular housing 51, an opener, such as a flow tube 52, a closure member, such as a flapper 53, a seat 54, and a receiver 55. To facilitate manufacturing and assembly, the housing 51 may include one or more sections (only one section shown) each connected together, such by threaded couplings and/or fasteners. Interfaces between the housing sections may be isolated, such as by seals. The housing sections may include an upper adapter (not shown) and a lower adapter (not shown), each having a threaded coupling for connection to other members of the inner casing string 11. The isolation valve 50 may have a longitudinal bore therethrough for passage of the drill string 5. Although shown as part of the housing 51, the seat 54 may be a separate member connected to the housing, such as by threaded couplings and/or fasteners. The receiver 55 may be connected to the housing 51, such as by threaded couplings and/or fasteners.

The flow tube 52 may be disposed within the housing 51 and be longitudinally movable relative thereto between a lower position (shown) and an upper position (not shown). The flow tube 52 may have one or more portions, such as an upper sleeve, a lower sleeve, and a piston connecting the upper and lower sleeves. The flow tube piston may carry a seal for sealing an interface formed between an outer surface thereof and an inner surface of the housing 51. Alternatively, the flow tube portions 52 may be separate members interconnected, such as by threaded couplings and/or fasteners.

A hydraulic chamber 56 may be formed in an inner surface of the housing 51. The housing 51 may have shoulders formed in an inner surface thereof adjacent to the chamber 56. The housing 51 may carry an upper seal located adjacent to an upper shoulder and a lower seal and wiper located adjacent to the lower shoulder for sealing the chamber 56 from the bore of the isolation valve 50. The hydraulic chamber 56 may be defined radially between the flow tube 52 and the housing 51 and longitudinally between the upper and lower shoulders. Hydraulic fluid 61 may be disposed in the chamber 56. The hydraulic fluid 61 may be an incompressible liquid, such as a water based mixture with glycol or a refined or synthetic oil. An upper end of the hydraulic chamber 56 may be in fluid communication with an opener hydraulic coupling 57*o* via an opener hydraulic passage 58*o* formed in and along a wall of the housing 51. A lower end of the hydraulic chamber 56 may be in fluid communication with a closer hydraulic coupling 57*c* via a closer hydraulic passage 58*c* formed in and along a wall of the housing 51.

The isolation valve 50 may further include a hinge 59. The flapper 53 may be pivotally connected to the seat 54 by the hinge 59. The flapper 53 may pivot about the hinge 59 between an open position (shown) and a closed position (not shown). The flapper 53 may be positioned below the seat 54 such that the flapper may open downwardly. The flapper 53 may have an undercut formed in at least a portion of an outer face thereof. The flapper undercut may facilitate engagement of an outer surface of the flapper 53 with a kickoff spring (not shown) connected to the housing 51, such as by a fastener. An inner periphery of the flapper 53 may engage a respective seating profile formed in an adjacent end of the seat 54 in the closed position, thereby sealing an upper portion of the valve bore from a lower portion of the valve bore. The interface between the flapper 53 and the seat 54 may be a metal to metal seal.

The hinge 59 may include a leaf, a knuckle of the flapper 53, one or more flapper springs, and a fastener, such as hinge pin, extending through holes of the flapper knuckle and a hole of each of one or more knuckles of the leaf. The seat 54 may have a recess formed in an outer surface thereof at an end adjacent to the flapper 53 for receiving the leaf. The leaf may be connected to the seat 54, such as by one or more fasteners.

The flapper 53 may be biased toward the closed position by the flapper springs, such as one or more inner and outer tension springs. Each tension spring may include a respective main portion and an extension. The seat 54 may have slots formed therethrough for receiving the flapper springs. An upper end of the main portions may be connected to the seat 54 at an end of the slots. The seat 54 may also have a guide path formed in an outer surface thereof for passage of the flapper springs to the flapper 53. Ends of the extensions may be connected to an inner face of the flapper 53. The kickoff spring may assist the tension springs in closing the flapper 53 due to the reduced lever arm of the spring tension when the flapper is in the open position.

Alternatively, the hinge may include a torsion spring instead of the tension springs and the kickoff spring. Alternatively, the leaf of the hinge 59 may be free to slide relative to the respective seat by a limited amount and a polymer seal ring may be disposed in a groove formed in the seating profile of the seat 54 such that the interface between the flapper inner periphery and the seating profile is a hybrid polymer and metal to metal seal. Alternatively, the seal ring may be disposed in the flapper inner periphery.

The flapper 53 may be opened and closed by interaction with the flow tube 52. Downward movement of the flow tube 52 may engage the lower sleeve 52*b* thereof with the flapper 53, thereby pushing and pivoting the flapper to the open position against the tension springs due to engagement of a bottom of the lower sleeve with an inner surface of the flapper. Upward movement of the flow tube 52 may disengage the lower sleeve thereof with the flapper 53, thereby allowing the tension springs to pull and pivot the flapper to the closed position due to disengagement of the lower sleeve bottom from the inner surface of the flapper.

When the flow tube 52 is in the lower position, a flapper chamber 60 may be formed radially between the housing 51 and the flow tube and the (open) flapper 53 may be stowed in the flapper chamber. The flapper chamber 60 may be formed longitudinally between the seat 54 and the receiver 55. The flow tube bottom may be positioned adjacent to an upper end of the receiver 55, thereby closing the flapper chamber 60. The flapper chamber 60 may protect the flapper 53 from abrasion by the drill string 5 and from being eroded and/or fouled by cuttings in drilling returns 31*f*. The flapper 53 may have a curved shape to conform to the annular shape of the flapper chamber 60 and the seating profile of the flapper seat 54 may have a curved shape complementary to the flapper curvature.

The control station 21 may include a console 21*c*, a microcontroller (MCU) 21*m*, and a display, such as a gauge 21*g*, in communication with the microcontroller 21*m*. The console 21*c* may be in communication with the manifold 36 via an operation line and be in fluid communication with the control lines 37*o,c* via respective pressure taps. The console 21*c* may have controls for operation of the manifold 36 by the technician and have gauges for displaying pressures in the respective control lines 37*o,c* for monitoring by the technician. The control station 21 may further include a pressure sensor (not shown) in fluid communication with the DPI sensing line 37*s* via a pressure tap and the MCU 21*m* may be in communication with the pressure sensor to receive a pressure signal therefrom. The auxiliary valve 31 may be assembled as part of the sensing line 37*s* and may be a shutoff valve for selectively providing fluid communication between the sensing line and the HPU accumulator.

Alternatively, the auxiliary valve 31 may be incorporated into the manifold 36 and an upper end of the sensing line 37*s* may connect to the manifold.

Figure 3A:
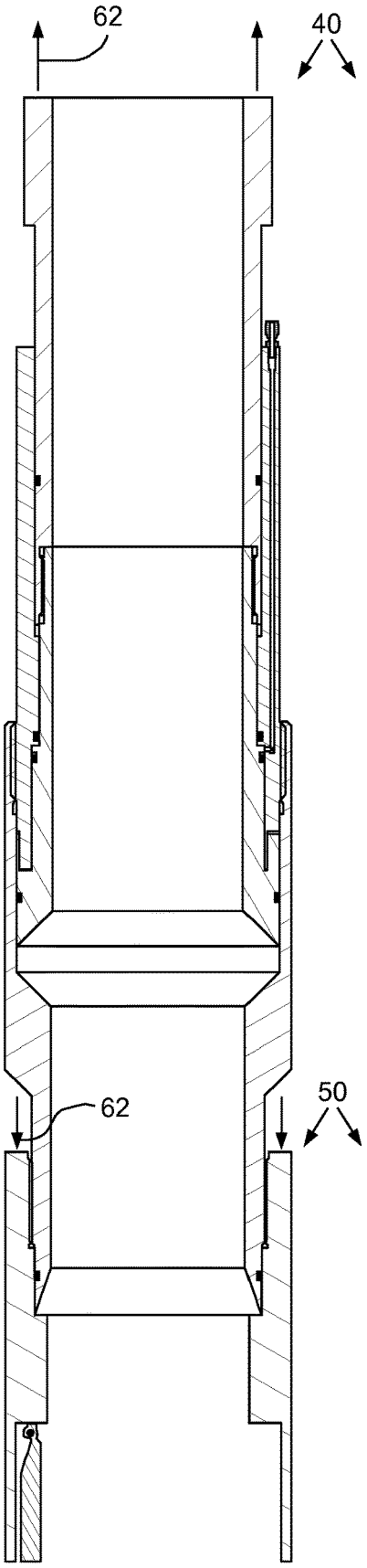
FIGS. 3A-3C illustrate operation of the DPI.

The fluid system if may include a mud pump 24, a drilling fluid reservoir, such as a pit 25 or tank, a solids separator, such as a shale shaker 26, a return line 29, a feed line, a supply line 30, a mud-gas separator (MGS) 38*s*, and a flare 38*f* (FIG. 3A). A first end of the return line 29 may be connected to a branch of the flow cross 19 and a second end of the return line may be connected to an inlet of the shaker 26. The returns pressure gauge 28*r* and returns shutoff valve 27*r* may be assembled as part of the return line 29. A first end of the choke spool 39 may be connected to the return line 29 between the returns pressure gauge 28*r* and the returns shutoff valve 27*r* and a second end of the choke spool may be connected to the shaker inlet. The choke shutoff valve 27*c*, choke valve 20, and MGS 38*s* may be assembled as part of the choke spool 39. The MGS 38*s* may include an inlet and a liquid outlet assembled as part of the choke spool 39 and a gas outlet connected to the flare 38*f* or a gas storage vessel (not shown).

A lower end of the supply line 30 may be connected to an outlet of the mud pump 24 and an upper end of the supply line may be connected to an inlet of the top drive 13. The supply pressure gauge 28*d* may be assembled as part of the supply line 30*p,h*. A lower end of the feed line may be connected to an outlet of the pit 25 and an upper end of the feed line may be connected to an inlet of the mud pump 24. The returns pressure gauge 28*r* may be operable to monitor wellhead pressure. The supply pressure gauge 28*d* may be operable to monitor standpipe pressure.

The drilling fluid 32*d* may include a base liquid. The base liquid may be refined or synthetic oil, water, brine, or a water/oil emulsion. The drilling fluid 32*d* may further include solids dissolved or suspended in the base liquid, such as organophilic clay, lignite, and/or asphalt, thereby forming a mud.

Once the inner casing string 11 has been deployed into the wellbore 8 and cemented 12 into place, the drill string 5 may then be deployed into the wellbore until the drill bit 33*b* is adjacent to the guide shoe 23. The drilling fluid 32*d* may then be circulated into the wellbore to displace chaser fluid (not shown) from a drilling annulus 34*d* formed between the drill string 5 and the inner casing string 11 and between the drill string 5 and a portion of the wellbore 8 being drilled through the lower formation 22*b*. Once the drilling fluid 32*d* has filled the annulus 34*d*, circulation may be halted such that only hydrostatic pressure of the drilling fluid 32 is exerted on an inner surface of the upper sleeve 52*u* and hydrostatic pressure of the hydraulic fluid 61 is exerted on an outer surface of the upper sleeve 52*u*. If the isolation valve 50 is not already open, the technician may operate the control station 21 to place the opener control line 37*o* in fluid communication with a reservoir of the HPU 35 via the manifold 36. The technician may then operate the control station 21 to shut-in the opener line 37*o*, thereby hydraulically locking the piston 52*p* in place. The technician may then operate the control station 21 to place the closer line 37*c* in communication with the accumulator of the HPU 35 via the manifold 36 and then to shut in the closer line with an initial pressure.

Alternatively, the closer line 37*c* may be shut-in with no pressure or left open in fluid communication with the HPU reservoir. Alternatively, the opener line 37*o* may be shut in at surface before deployment of the inner casing string 11.

To extend the wellbore 8 from the casing shoe 23 into the lower formation 22*b*, the mud pump 24 may pump the drilling fluid 32 from the pit 25, through a standpipe and Kelly hose of the supply line 30 to the top drive 13. The drilling fluid 32*d* may flow from the supply line 30 and into the drill string 5 via the top drive 13. The drilling fluid 32*d* may be pumped down through the drill string 5 and exit the drill bit 33*b*, where the fluid may circulate the cuttings away from the bit and return the cuttings up the drilling annulus 34*d*. The returns 32*r* (drilling fluid plus cuttings) may flow up the drilling annulus 34*d* to the wellhead 6 and exit the wellhead at the flow cross 19. The returns 32*r* may continue through the return line 29 and into the shale shaker 26 and be processed thereby to remove the cuttings, thereby completing a cycle. As the drilling fluid 32*d* and returns 32*r* circulate, the drill string 5 may be rotated 4*r* by the top drive 13 and lowered 4*a* by the traveling block 14, thereby extending the wellbore 8 into the lower formation 22*b*.

Figure 2A:
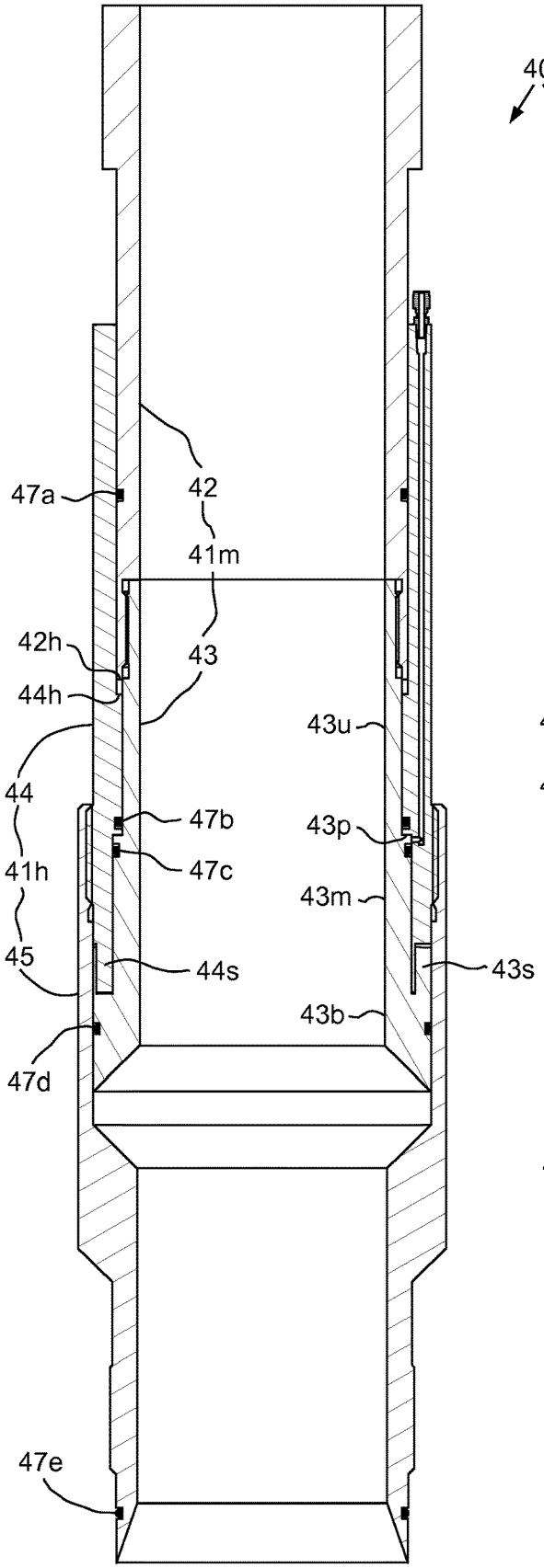
FIGS. 2A and 2B illustrate a differential pressure indicator (DPI) of the drilling system.
Figure 2B:
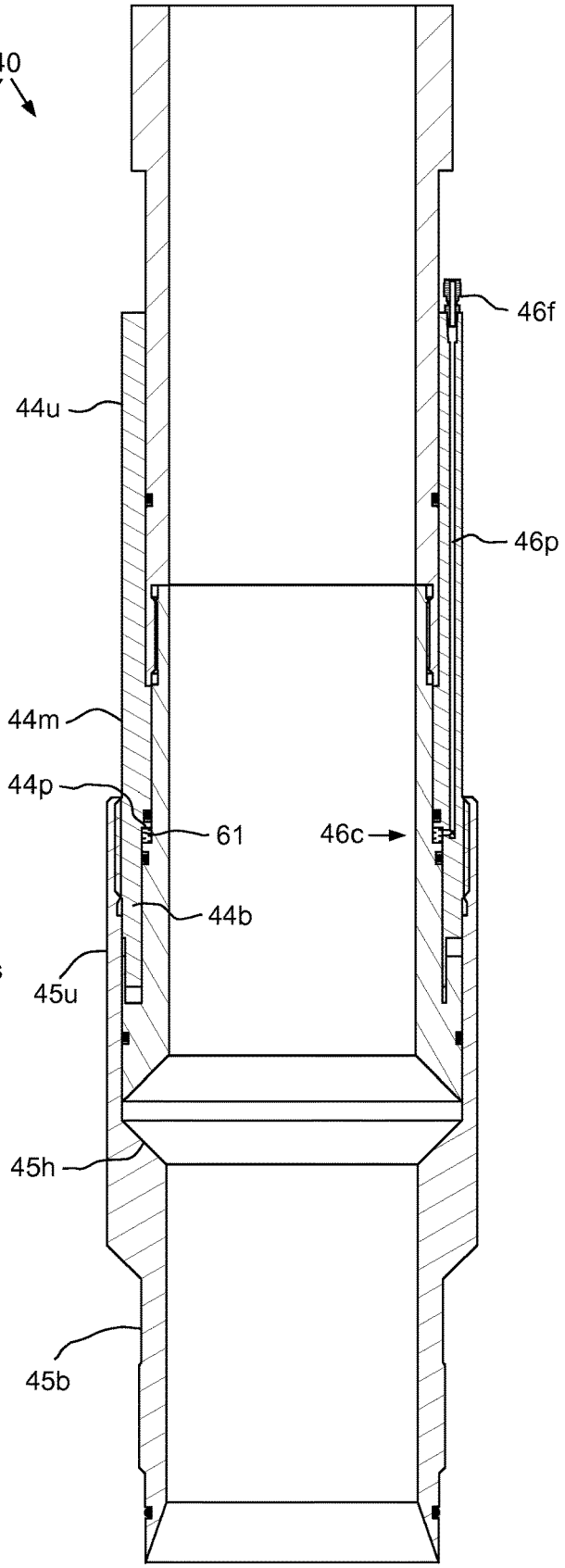

FIGS. 2A and 2B illustrate the DPI 40. The DPI 40 may include a tubular mandrel 41*m* and a tubular housing 41*h*. The mandrel 41*m* and the housing 41*h* may be longitudinally movable relative to each other between an extended position (FIG. 2A) and a retracted position (FIG. 2B). The DPI 40 may have a longitudinal bore therethrough for passage of the drill string 5. The mandrel 41*m* may include two or more sections, such as an adapter 42 and a piston 43, each connected together, such by threaded couplings (shown) and/or fasteners (not shown). The housing 41*h* may include two or more sections, such as a piston 44 and an adapter 45, each connected together, such by threaded couplings (shown) and/or fasteners (not shown).

The mandrel adapter 42 may also have a threaded coupling (not shown) formed at an upper end thereof for connection to another member of the inner casing string 11. The housing adapter 45 may also have a threaded coupling formed at a lower end thereof for connection to an upper end of the isolation valve 50. The housing adapter 45 may also carry a seal 47*e* for sealing an interface between the DPI 40 and the isolation valve 50. The mandrel adapter 42 may carry a seal 47*a* for sealing an upper interface formed between mandrel 41*m* and the housing 41*h* and the mandrel piston 43 may carry a seal 47*d* for sealing a lower interface formed between mandrel and the housing, thereby sealing a bore of the DPI 40 from the casing annulus 34*c*. The mandrel 41*m* and housing 41*h* may be made from a metal or alloy, such as steel, stainless steel, or a nickel based alloy, having strength sufficient to support the isolation valve 50, any casing joints of the free portion 11*f* below the isolation valve, and the cemented portion 11*c*.

The mandrel piston 43 may have an upper portion 43*u*, a mid portion 43*m* having an enlarged outer diameter relative to the upper portion, and a lower portion 43*b* having an enlarged outer diameter relative to the mid portion. The upper portion 43*u* may have the threaded coupling formed in an outer surface thereof and connecting the mandrel piston 43 to the mandrel adapter 42. A piston shoulder 43*p* may be formed between the upper 43*u* and mid 43*m* portions in an outer surface of the mandrel piston 43. A torsional coupling, such as spline teeth 43*s* and spline grooves, may be formed between the mid and lower 43*b* portions in the outer surface of the mandrel piston 43. An outer diameter of the mandrel adapter 42 may be greater than an outer diameter of the mandrel piston upper portion 43*u* such that a lower end of the mandrel adapter may serve as a stop shoulder 42*h*. The threaded coupling connecting the mandrel piston 43 to the mandrel adapter 42 may be formed in an inner surface of the mandrel adapter 42 adjacent to the lower end thereof.

The housing piston 44 may receive a lower portion of the mandrel adapter 42 and the upper 43*u* and mid 43*m* portions of the mandrel piston 43. The housing piston 44 may have an upper portion 44*u*, a mid portion 44*m* having a reduced inner diameter relative to the upper portion, and a lower portion 44*b* having an enlarged inner diameter relative to the mid portion. A stop shoulder 44*h* may be formed between the upper 44*u* and mid 44*m* portions in an inner surface of the housing piston 44. A piston shoulder 44*p* may be formed between the mid 44*m* and lower 44*b* portions in the inner surface of the housing piston 44. The mid 44*m* and lower 44*b* portions may have the threaded coupling connecting the housing piston 44 to the housing adapter 45 formed in an outer surface thereof. A torsional coupling, such as spline teeth 44*s* and spline grooves, may be formed in a lower end of the housing piston 44. The housing adapter 45 may receive part of the mid portion 44*m* and the lower portion 44*b* of the housing piston 44 and the lower portion 43*b* of the mandrel piston 43. The housing adapter 45 may have an upper portion 45*u*, a lower portion 45*b* having a reduced inner diameter relative to the upper portion, and a shoulder 45*h* joining the upper and lower portions. The upper portion 45*u* may have the threaded coupling connecting the housing piston 44 to the housing adapter 45 formed in an inner surface thereof.

Alternatively, each torsional coupling may include a keyway formed in the respective housing 41*h* and mandrel 41*m* and the torsional connection completed by a key inserted therein.

The piston shoulders 43*p*, 44*p* may be engaged when the DPI 40 is in the extended position and the stop shoulders 42*h*, 44*h* may be engaged when the DPI 40 is in the retracted position. A hydraulic chamber 46*c* may be formed longitudinally between the piston shoulders 43*p*, 44*p* when the DPI 40 is in the retraced position. The hydraulic chamber 46*c* may be formed radially between an inner surface of the mandrel piston upper portion 43*b* and an outer surface of the housing piston lower portion 44*b*. The housing piston 44 may carry a seal 47*b* in an inner surface of the mid portion 44*m* located adjacent to the piston shoulder 44*p* and the mandrel piston 43 may carry a seal 47*c* in an outer surface of the mid portion 43*m* located adjacent to the piston shoulder 43*p* for sealing the hydraulic chamber 46*c* from the DPI bore. The hydraulic fluid 61 may be disposed in the chamber 46*c*. The hydraulic chamber 46*c* may be in fluid communication with a hydraulic coupling 46*f* via a hydraulic passage 46*p* formed in a wall of and along the housing piston 44.

The DPI 40 may be biased toward the extended position by tension 62 exerted on the DPI mandrel 41*m* by the free portion 11*f* being hung from the wellhead 6 and weight of the DPI housing 41*h*, the isolation valve 50, any casing joints of the free portion 11*f* below the isolation valve, and the cemented portion 11*c*. Injection of the hydraulic fluid 61 into the chamber 46*c* may overcome the bias and retract the DPI 40 by exerting upward pressure on the housing piston shoulder 44*p* and downward pressure on the mandrel piston shoulder 43*p*. A stroke length of the DPI 40 may be infinitesimal relative to a length of the DPI 40, such as less than one tenth, one twentieth, one fiftieth, or one hundredth. The infinitesimal stroke length may avoid the need for slip joints in the control lines 37*o,c* and the sensing line 37*s*. Torsional connection between the housing 41*h* and the mandrel 41*m* may be maintained in and between the retracted and the extended positions by the engaged spline couplings 43*s*, 44*s*.

Figure 3B:
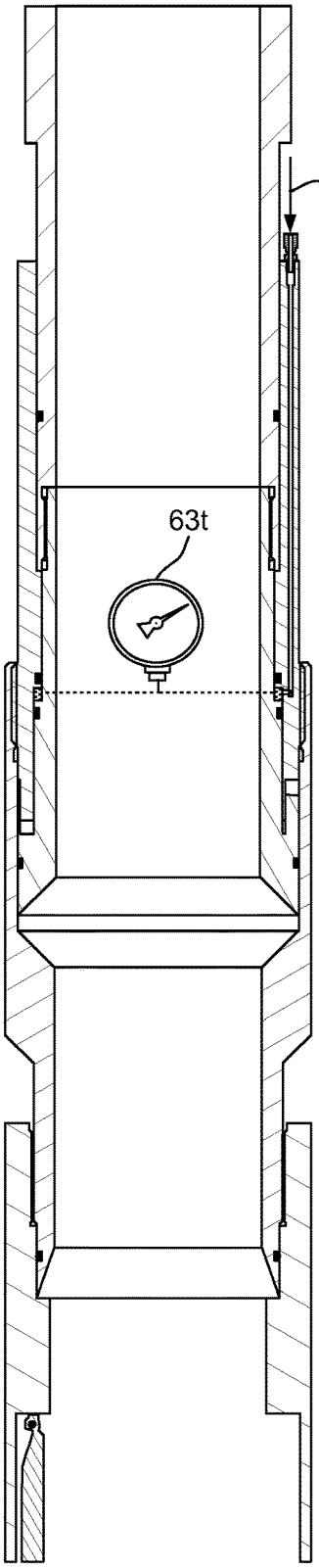
Figure 3C:
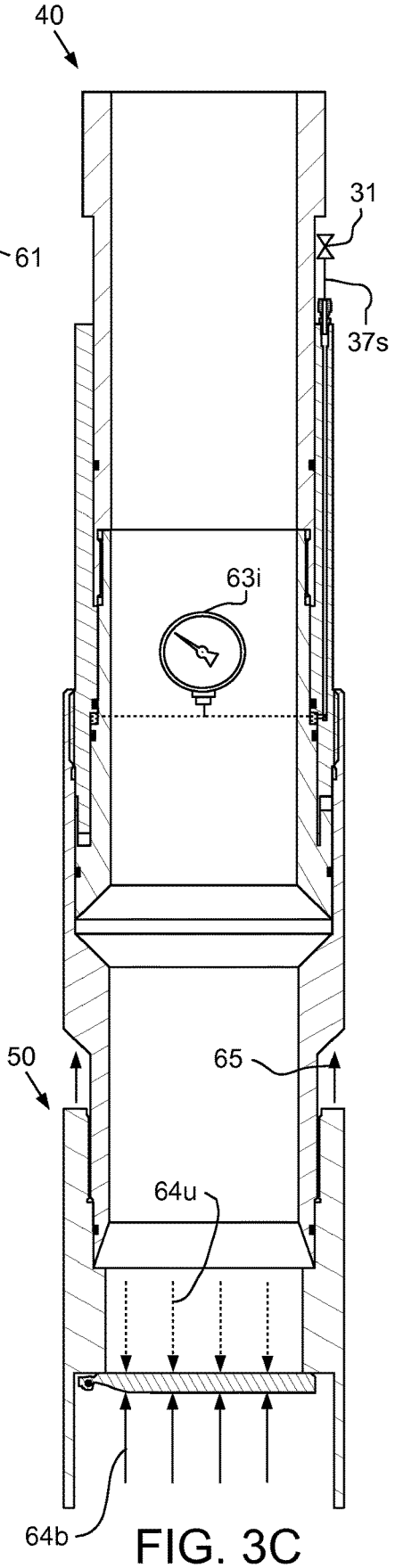

FIGS. 3A-3C illustrate operation of the DPI 40. Referring specifically to FIG. 3A, during deployment of the inner casing string 11, deployment of the drill string 5, and drilling of the lower formation 22*b*, the isolation valve 50 may be open and the DPI 40 idle in the extended position.

Referring specifically to FIG. 3B, after drilling of the lower formation 22*b* to total depth, the drill string 5 may be raised to such that the drill bit 33*b* is above the flapper 53. The technician may then open the auxiliary valve 31 to supply pressurized hydraulic fluid 61 from the HPU accumulator to the DPI chamber 46*c* via the sensing line 37*s*, the coupling 46*f*, and the passage 46*p*. The DPI 40 may stroke to the retracted position at a threshold pressure 63*t* generating a retraction force (not shown) sufficient to overcome the tension 62 in the inner casing string 11 and to stretch the inner casing string 11 by amount corresponding to the stroke length of the DPI 40 (may be negligible due to infinitesimal stroke length). The HPU accumulator may have a level indicator for monitoring a volume expended therefrom to retract the DPI 40. Once the threshold pressure 63*t* has been reached, the technician may then close the auxiliary valve 31, thereby shutting in the DPI chamber 46*c*, and instruct the MCU 21*m* to record the threshold pressure.

If the tie-back alternative, discussed above, is employed, the retraction force generated by the threshold pressure may only need to overcome the tension in the tieback casing string. Alternatively, pressure may be monitored within the system while tension is pulled on its parent casing to correlate observed pressure fluctuations with the initial tension set on the casing string.

Referring specifically to FIG. 3C, the technician may then close the isolation valve 50 by operating the control station 21 to supply pressurized hydraulic fluid 61 from the HPU accumulator to the closer passage 58*c* and to relieve hydraulic fluid from the opener passage 58*o* to the HPU reservoir. The pressurized hydraulic fluid 61 may flow from the manifold 36 through the wellhead 6 and into the wellbore via closer line 37*c*. The pressurized hydraulic fluid 61 may flow down the closer line 37*c* and into the closer passage 58*c* via the hydraulic coupling 57*c*. The hydraulic fluid 61 may exit the passage 58*c* into the hydraulic chamber lower portion and exert pressure on a lower face of the flow tube piston, thereby driving the piston upwardly relative to the housing 51.

Alternatively, the drill string 5 may need to be removed for other reasons before reaching total depth, such as for replacement of the drill bit 33*b*.

As the piston 52*p* begins to travel, hydraulic fluid 61 displaced from the hydraulic chamber upper portion may flow through the opener passage 58*o* and into the opener line 37*o* via the hydraulic coupling 570. The displaced hydraulic fluid 61 may flow up the opener line 37*o*, through the wellhead 6, and exit the opener line into the hydraulic manifold 36. As the piston 52*p* travels and the lower sleeve 52*b* clears the flapper 53, the tension springs may close the flapper. Movement of the piston 52*p* may be halted by abutment of an upper face thereof with the upper housing shoulder. Once the flapper 53 has closed, the technician may then operate the control station 21 to shut-in the closer line 37*c* or both of the control lines 37*o,c*, thereby hydraulically locking the piston 52*p* in place. Drilling fluid 32 may be circulated (or continue to be circulated) in an upper portion of the wellbore 8 (above the lower flapper) to wash an upper portion of the isolation valve 50. The drill string 5 may then be retrieved to the rig 1*r*.

Once circulation has been halted and/or the drill string 5 has been retrieved to the rig 1*r*, pressure 64*u* in the inner casing string 11 acting on an upper face of the flapper 53 may be reduced relative to pressure 64*b* in the inner casing string acting on a lower face of the flapper, thereby creating a net upward force 65 on the flapper which is transferred to the DPI housing 41*h* via the isolation valve housing 51. Since the net upward force 65 generated by the pressure differential 63*u,b* across the flapper 53 also tends to retract the DPI 40, the pressure in the DPI chamber 46*c* is reduced to an indication pressure 63*i*.

The indication pressure 63*i* may be detected by the MCU 21*m* and used thereby to calculate a delta pressure between the indication and threshold 63*t* pressures. The MCU 21*m* may be programmed with a correlation between the calculated delta pressure and the pressure differential 64*u,b* across the flapper 53. The MCU 21*m* may then convert the delta pressure to a pressure differential across the flapper 53 using the correlation. The MCU 21*m* may then output the converted pressure differential to the gauge 21*g* for monitoring by the technician.

The correlation may be determined theoretically using parameters, such as geometry of the flapper 53, isolation valve housing 51, DPI housing 41*h*, and DPI mandrel 41*m*, and material properties thereof, to construct a computer model, such as a finite element and/or finite difference model, of the DPI 40 and isolation valve 50 and then a simulation may be performed using the model to derive a formula. The model may or may not be empirically adjusted.

The control station 21 may further include an alarm (not shown) operable by the MCU 21*m* for alerting the technician, such as a visual and/or audible alarm. The technician may enter one or more alarm set points into the control station 21 and the MCU 21*m* may alert the technician should the converted annulus pressure violate one of the set points. A maximum set point may be a design pressure of the flapper 53. Weight of the DPI housing 41*h*, the isolation valve 50, any casing joints of the free portion 11*f* below the isolation valve, and the cemented portion 11*c* may be sufficient such that the tension 62 is greater than or equal to the net upward force 65 generated by a pressure differential 64*u,b* equal to the design pressure of the flapper 65, thereby ensuring that a measurement range of the DPI 40 is broad enough to include the flapper design pressure.

If total depth has not been reached, the drill bit 33*b* may be replaced and the drill string 5 may be redeployed into the wellbore 8. The DPI 40 may also be used to monitor differential pressure while tripping into the hole to gauge surge and swab effects.

Pressure in the upper portion of the wellbore 8 may then be equalized with pressure in the lower portion of the wellbore 8 using the converted pressure differential displayed by the gauge 21*g* to ensure proper equalization. The technician may then operate the control station 21 to supply pressurized hydraulic fluid to the opener line 37*o* while relieving the closer line 37*c*, thereby opening the flapper 53. Once the flapper 53 has been opened, the technician may then operate the control station 21 to shut-in the opener line 37*c* or both of the control lines 37*o,c*, thereby hydraulically locking the flow tube piston in place. Drilling may then resume. In this manner, the lower formation 22*b* may remain live during tripping due to isolation from the upper portion of the wellbore 8 by the closed isolation valve 50, thereby obviating the need to kill the lower formation 22*b*.

Once drilling has reached total depth, the drill string 5 may be retrieved to the drilling rig 1*r*, as discussed above. A liner string (not shown) may then be deployed into the wellbore 8 using a work string (not shown). The liner string and workstring may be deployed into the live wellbore 8 using the isolation valve 50, as discussed above for the drill string 5. Once deployed, the liner string may be set in the wellbore 8 using the work string. The work string may then be retrieved from the wellbore 8 using the isolation valve 50 as discussed above for the drill string 5. The PCA 1*p* may then be removed from the wellhead 6. A production tubing string (not shown) may be deployed into the wellbore 8 and a production tree (not shown) may then be installed on the wellhead 6. Hydrocarbons (not shown) produced from the lower formation 22*b* may enter a bore of the liner, travel through the liner bore, and enter a bore of the production tubing for transport to the surface 9.

Alternatively, each piston shoulder 43*p*, 44*p* may be transposed with the respective stop shoulder 42*h*, 44*h*, the passage 46*p* formed in a wall of and along the mandrel 41*m* instead of the housing 41*h*, thereby causing the indication pressure 63*i* to increase with increasing differential pressure 63*u,b* across the flapper 53. In a further variant of this alternative, the DPI may have a pressure sensor in fluid communication with the DPI chamber and the sensing line may be an electric or optical cable for transmission of a signal from the sensor to the control station.

Figure 4A:
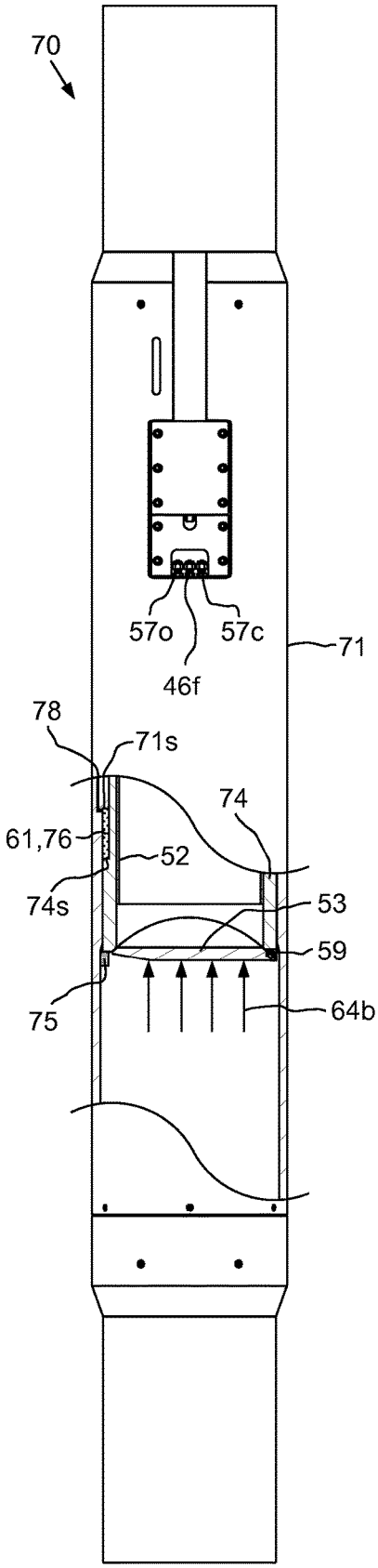
FIGS. 4A-4D illustrate isolation valves having integrated DPIs, according to other embodiments of the present disclosure.

FIGS. 4A-4D illustrate isolation valves 70, 80, 90, 100 having integrated DPIs, according to other embodiments of the present disclosure. Referring specifically to FIG. 4A, the isolation valve 70 may include a tubular housing 71, an opener, such as the flow tube 52, a closure member, such as the flapper 53, the opener coupling 57*o*, the closer coupling 57*c*, the hinge 59, a seat 74, a seat receiver 75, and a flow tube receiver (not shown).

To facilitate manufacturing and assembly, the housing 71 may include one or more sections (only one section shown) each connected together, such by threaded couplings and/or fasteners. Interfaces between the housing sections may be isolated, such as by seals. The housing sections may include an upper adapter and a lower adapter, each having a threaded coupling for connection to other members of the inner casing string 11. The isolation valve 70 may have a longitudinal bore therethrough for passage of the drill string 5. The housing 71 may have the hydraulic chamber 56 (not shown) and the passages 58*o,c* (not shown) for operation of the flow tube 52. Each of the flow tube receiver and seat receiver 75 may be connected to the housing 71. The housing may also have a piston shoulder 71*s* formed in an inner surface thereof.

The flapper 53 may be pivotally connected to the seat 74 by the hinge 59. An inner periphery of the flapper 53 may engage a respective seating profile formed in an adjacent end of the seat 74 in the closed position, thereby sealing an upper portion of the valve bore from a lower portion of the valve bore. The interface between the flapper 53 and the seat 74 may be a metal to metal seal.

The seat 74 may be longitudinally movable relative to the housing 71 between an upper position (not shown) and a lower position (shown). The seat 74 may be stopped in the lower position by the seat receiver 75. The seat 74 may have a piston shoulder 74*s* formed in an inner surface thereof. The isolation valve 70 may further include a DPI chamber 76 formed longitudinally formed between the housing shoulder and the seat shoulder 74*s*. The housing 71 may carry a seal located adjacent to the shoulder 71*s* and the seat 74 may carry a seal located adjacent to the shoulder 74*s* for sealing the DPI chamber 76 from the bore of the isolation valve 70. The DPI chamber 76 may be defined radially between the seat 74 and the housing 71. Hydraulic fluid 61 may be disposed in the DPI chamber 76. The DPI chamber 76 may be in fluid communication with the sensing coupling 46*f* via a hydraulic passage 78 formed in and along a wall of the housing 71. The sensing line 37*s* (not shown) may connect the coupling 46*f* to the control station 21 and the HPU 35.

In operation, the seat 74 may be maintained in the lower position by a threshold pressure in the DPI chamber 76 and the DPI chamber being shut in by the valve 31 whether the isolation valve 70 is closed or open. When the isolation valve 70 is closed, the MCU 21*m* may monitor pressure in the sensing line 37*s*, calculate a delta pressure, and use a correlation to calculate differential pressure across the flapper 53. As compared to the DPI 40, a net upward force on the flapper 53 will increase pressure in the DPI chamber 76 instead of reducing pressure and the isolation valve 70 may be located in either the free portion 11*f* or the cemented portion 11*c*.

Alternatively, the DPI chamber 76 may be in fluid communication with either the opener passage or the closer passage and the sensing coupling 46*f* and sensing line 37*s* may be omitted.

Figure 4B:
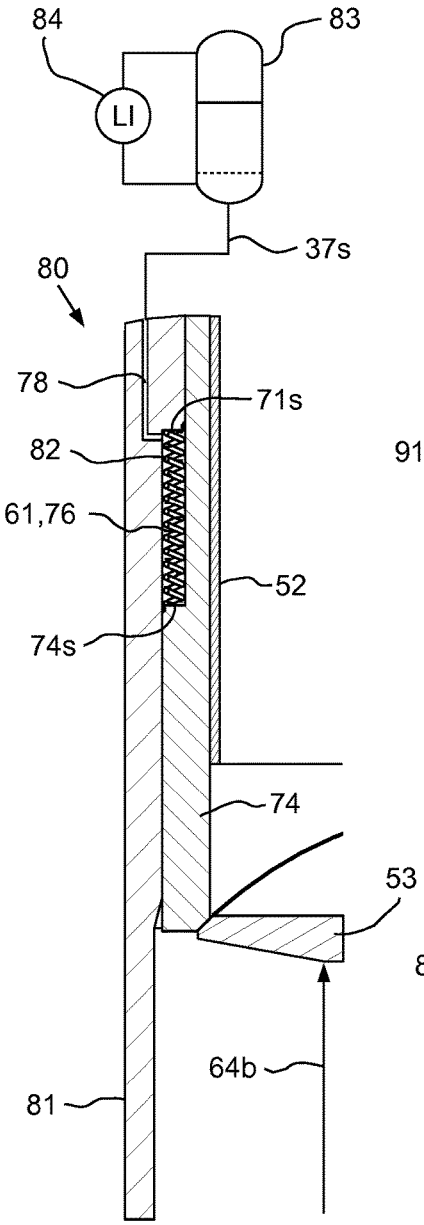

Referring specifically to FIG. 4B, the isolation valve 80 may include a tubular housing 81, an opener, such as the flow tube 52, a closure member, such as the flapper 53, the opener coupling 57*o*, the closer coupling 57*c*, the hinge 59, a seat 74, a seat receiver (not shown), and a flow tube receiver (not shown). The valve 80 may be similar to the valve 70 except that a biasing member, such as compression spring 82 may be disposed in the DPI chamber 76. An upper end of the compression spring 82 may bear against the housing shoulder 71*s* and a lower end of the compression spring may bear against the seat shoulder 74*s*, thereby biasing the seat 74 toward the lower position. A stiffness and stroke of the spring 82 may be selected such that the spring may bottom out at the flapper design pressure. Further, the control station 21 may include an accumulator 83 for operation of the isolation valve 80 having a level sensor 84 in communication with the MCU 21*m* and the shutoff valve 31 and connection to the HPU 35 by the sensing line may be omitted.

In operation, the DPI chamber 76 may be in communication with the accumulator 83 whether the isolation valve 80 is open or closed. When the isolation valve 80 is closed, a net upward force on the flapper 53 may drive the seat 74 upward against the spring 82, thereby expelling hydraulic fluid 61 from the DPI chamber 76 into the accumulator 83. The MCU 21*m* may monitor a fluid level in the accumulator 83 using the level sensor 84 to determine a volume of the hydraulic fluid 61 expelled from the DPI chamber 76 and calculate a change in length of the spring 82 using an area of the DPI chamber 76. Once the MCU 21*m* has calculated the spring length, the MCU 21*m* may then determine the differential pressure across the flapper 53 using a stiffness of the spring 82 and geometry of the flapper 53.

Figure 4C:
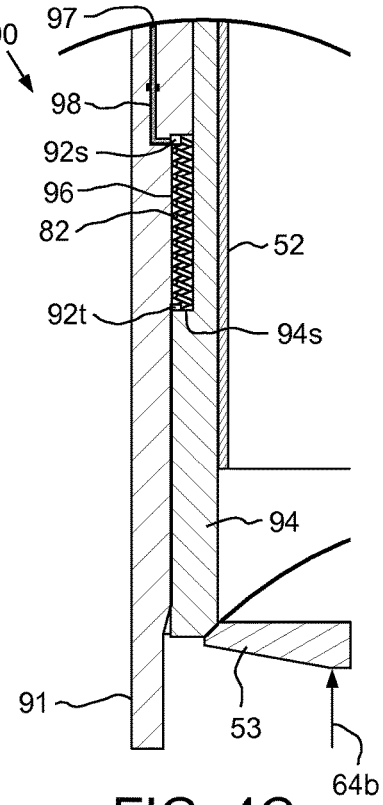

Referring specifically to FIG. 4C, the isolation valve 90 may include a tubular housing 91, an opener, such as the flow tube 52, a closure member, such as the flapper 53, the opener coupling 570, the closer coupling 57*c*, the hinge 59, a seat 94, a biasing member, such as the compression spring 82, a DPI chamber 96, a seat receiver (not shown), and a flow tube receiver (not shown). The valve 90 may be similar to the valve 80 except that the hydraulic fluid 61 may be omitted from the DPI chamber 96 and a proximity sensor 92*s* and target 92*t* disposed at respective ends of the DPI chamber 96. The housing 91 may have a sealed conduit 98 for receiving leads 97 extending from the proximity sensor 92*s* to an electrical coupling (not shown, replaces hydraulic coupling 46*f*). A sensing cable (not shown) may extend from the isolation valve 90 to the control station 21 instead of the sensing line 37*s*. The sensing cable may extend to the control station 21 independently of the control lines 37*o,c* or be bundled therewith in the umbilical.

The target 92*t* may be a ring made from a magnetic material or permanent magnet and may be mounted to the seat shoulder 94*s* by being bonded or press fit into a groove formed in the shoulder face. The sensor 92*s* may be mounted to the housing 91 adjacent to the shoulder 91*s*. Each of the housing 91 and the seat 94 may be made from a diamagnetic or paramagnetic material. The proximity sensor 92*s* may or may not include a biasing magnet depending on whether the target 92*t* is a permanent magnet. The proximity sensor 92*s* may include a semiconductor and may be in electrical communication with the leads 97 for receiving a regulated current. The proximity sensor 92*s* and/or target 92*t* may be oriented so that the magnetic field generated by the biasing magnet/permanent magnet target is perpendicular to the current. The proximity sensor 92*s* may further include an amplifier for amplifying the Hall voltage output by the semiconductor when the target 92*t* is in proximity to the sensor.

Alternatively, the proximity sensor may include, but is not limited to inductive, capacitive, optical, or utilization of wireless identification tags. Alternatively, the sensor 92*s* and target 92*t* may each be connected to a respective end of the spring 82.

In operation, when the isolation valve 90 is closed, a net upward force on the flapper 53 may drive the seat 94 upward against the spring 82, thereby moving the target 92*t* toward the sensor 92*s*. The MCU 21*m* may monitor the sensor 92*s* and determine a length of the spring 82. The MCU 21*m* may then determine the differential pressure across the flapper 53 using a stiffness of the spring 82 and geometry of the flapper 53.

Figure 4D:
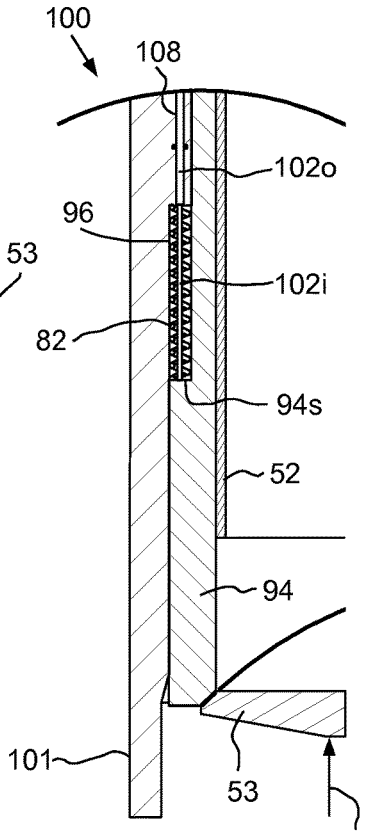

Referring specifically to FIG. 4D, the isolation valve 100 may include a tubular housing 101, an opener, such as the flow tube 52, a closure member, such as the flapper 53, the opener coupling 57*o*, the closer coupling 57*c*, the hinge 59, the seat 94, a biasing member, such as the compression spring 82, a DPI chamber 96, a seat receiver (not shown), and a flow tube receiver (not shown). The valve 100 may be similar to the valve 90 except for having a position sensor 102*i,o* instead of the proximity sensor 92*s* and target 92*t*.

The position sensor 102*i,o* may be a linear variable differential transformer (LVDT) having an outer tube 102*o* and an inner ferromagnetic core 102*i*. The outer tube 102*o* may be disposed in the sealed conduit 108 and mounted to the housing 101. The outer tube 102*o* may be in electrical communication with the electrical coupling via leads (not shown). The inner core 102*i* may extend from the outer tube 102*o*, through the DPI chamber 96 and have a lower end connected to the seat shoulder 94*s*. The outer tube 102*i* may have a central primary coil (not shown) and a pair of secondary coils (not shown) straddling the primary coil. The primary coil may be driven by an AC signal and the secondary coils monitored for response signals which may vary in response to position of the core 102*i* relative to the outer tube 102*o*.

In operation, when the isolation valve 100 is closed, a net upward force on the flapper 53 may drive the seat 94 upward against the spring 82, thereby contracting the position sensor 102*i,o*. The MCU 21*m* may monitor the sensor 102*i,o* and determine a length of the spring 82. The MCU 21*m* may then determine the differential pressure across the flapper 53 using a stiffness of the spring 82 and geometry of the flapper 53.

Alternatively, each end of the position sensor 102*i,o* may be connected to a respective end of the spring 82.

Figure 5A:
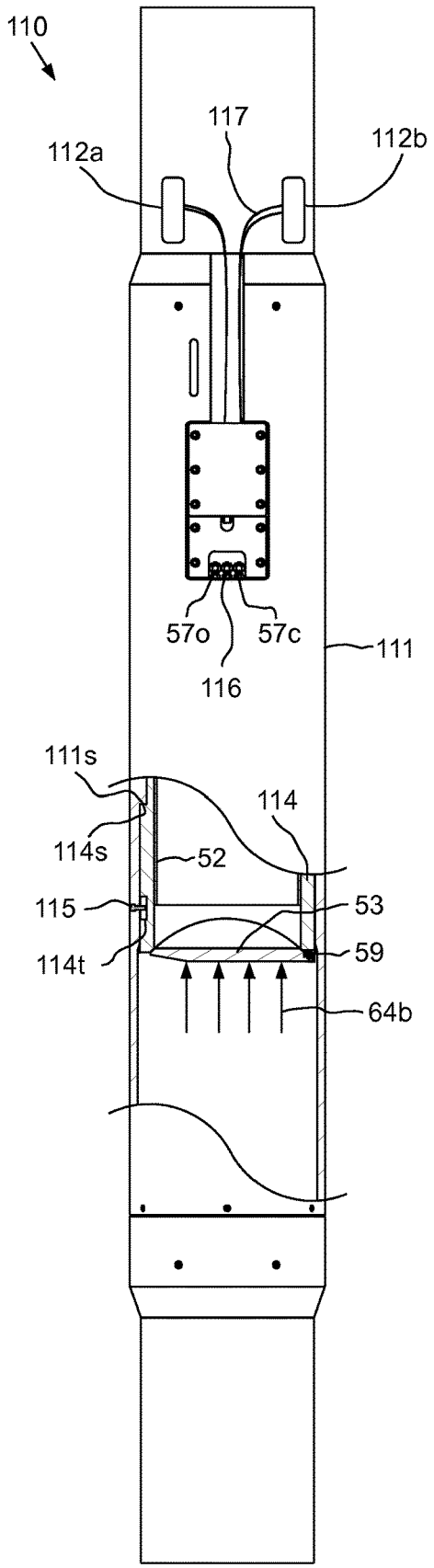
FIGS. 5A-5C illustrate further isolation valves having integrated DPIs, according to other embodiments of the present disclosure.
Figure 5B:
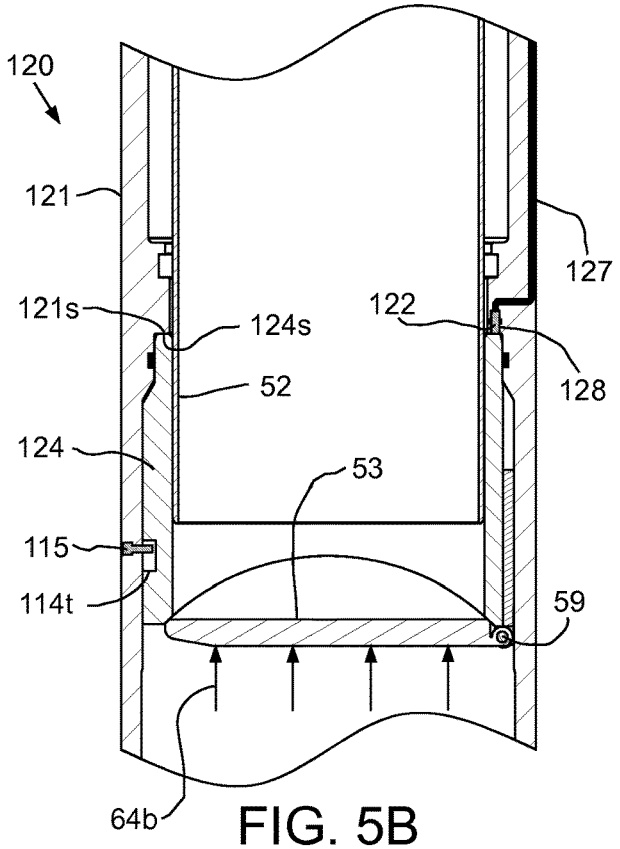
Figure 5C:
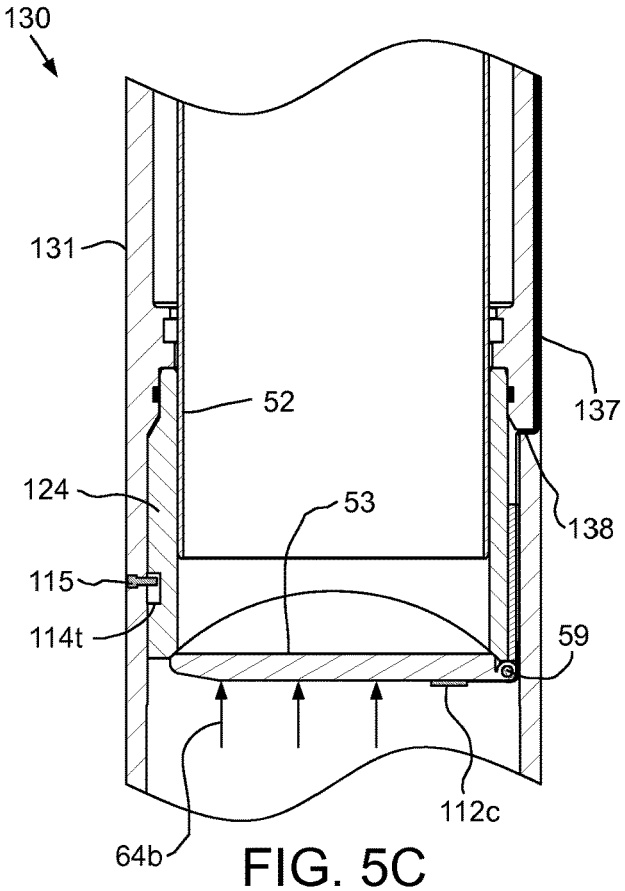

FIGS. 5A-5C illustrate further isolation valves 110, 120, 130 having integrated DPIs, according to other embodiments of the present disclosure. Referring specifically to FIG. 5A, the isolation valve 110 may include a tubular housing 111, an opener, such as the flow tube 52, a closure member, such as the flapper 53, the opener coupling 57*o*, the closer coupling 57*c*, the hinge 59, a seat 114, an electrical coupling 116, and a flow tube receiver (not shown).

To facilitate manufacturing and assembly, the housing 111 may include one or more sections (only one section shown) each connected together, such by threaded couplings and/or fasteners. Interfaces between the housing sections may be isolated, such as by seals. The housing sections may include an upper adapter and a lower adapter, each having a threaded coupling for connection to other members of the inner casing string 11. The isolation valve 110 may have a longitudinal bore therethrough for passage of the drill string 5. The housing 110 may have the hydraulic chamber 56 (not shown) and the passages 58*o,c* (not shown) for operation of the flow tube 52. Each of the flow tube receiver and seat receiver 75 may be connected to the housing 111. The housing may also have a shoulder 111*s* formed in an inner surface thereof.

The upper adapter section may have one or more strain gages 112*a,b* mounted on an outer surface thereof. Leads 117 may extend from each strain gage 112*a,b* to the electrical coupling 116. A sensing cable (not shown) may extend from the isolation valve 110 to the control station 21. The sensing cable may extend to the control station 21 independently of the control lines 37*o,c* or be bundled therewith in the umbilical. Each strain gage 112*a,b* may be foil, semiconductor, piezoelectric, or magnetostrictive. Each strain gage 112*a,b* may be oriented (i.e., parallel or diagonal) relative to a longitudinal axis of the housing 111 to measure longitudinal strain of the upper adapter section due to force exerted thereon by the closed flapper 53. Additional strain gages may be disposed on the upper adapter section to account for temperature and/or increase sensitivity.

The flapper 53 may be pivotally connected to the seat 114 by the hinge 59. An inner periphery of the flapper 53 may engage a respective seating profile formed in an adjacent end of the seat 114 in the closed position, thereby sealing an upper portion of the valve bore from a lower portion of the valve bore. The interface between the flapper 53 and the seat 114 may be a metal to metal seal. The seat 114 may be linked to the housing, such as by a fastener 115 and slot 114*t* joint to allow limited longitudinal movement of the seat 114 relative to the housing 111 between an upper position (shown) and a lower position (not shown). The seat 114 may have a shoulder 114*s* formed in an inner surface thereof. The seat 114 may be stopped in the upper position by engagement of the shoulders 114*s*, 111*s*.

In operation, when the isolation valve 110 is closed, a net upward force on the flapper 53 may push the seat 94 upward toward the housing 111 until the shoulders 114*s*, 111*s* engage, thereby relieving tension on the upper adapter section. The MCU 21*m* may monitor the strain gages 112*a,b* and determine the force exerted on the housing 111 by the closed flapper 53. The MCU 21*m* may then determine the differential pressure across the flapper 53 using geometry of the flapper 53.

Referring specifically to FIG. 5B, the isolation valve 120 may include a tubular housing 121, an opener, such as the flow tube 52, a closure member, such as the flapper 53, the opener coupling 57*o*, the closer coupling 57*c*, the hinge 59, a seat 124, the slip joint 114*t*, 115, the electrical coupling 116, and a flow tube receiver (not shown). The valve 120 may be similar to the valve 110 except for having a load cell 122 instead of the strain gages 112*a,b*.

A sensing cable (not shown) may extend from the isolation valve 120 to the control station 21. The load cell 122 may be disposed in a sealed conduit 128 adjacent to a shoulder 121*s* formed in an inner surface of the housing 121 and mounted to the housing. Leads 127 may extend from the load cell 122 to the electrical coupling 116. The load cell 122 may be hydraulic, pneumatic, or mechanical (strain gage). An upper end of the seat 124 may serve as a shoulder 124*s* for engaging the load cell 122.

In operation, when the isolation valve 120 is closed, a net upward force on the flapper 53 may push the seat 124 upward toward the housing 121 until the shoulder 124*s* engages the load cell 122. The MCU 21*m* may monitor the load cell 122 and determine the force exerted thereon by the closed flapper 53. The MCU 21*m* may then determine the differential pressure across the flapper 53 using geometry of the flapper 53.

Referring specifically to FIG. 5C, the isolation valve 130 may include a tubular housing 131, an opener, such as the flow tube 52, a closure member, such as the flapper 53, the opener coupling 57*o*, the closer coupling 57*c*, the hinge 59, a seat 124, the slip joint 114*t*, 115, the electrical coupling 116, and a flow tube receiver (not shown). The valve 130 may be similar to the valve 110 except for having a strain gage 112*c* mounted to the outer face of the flapper 53. The strain gage 112*c* may be similar to the strain gages 112*a,b*. Leads 137 may extend from the strain gage 112*c* to the electrical coupling 116 via a sealed conduit 138. A sensing cable (not shown) may extend from the isolation valve 130 to the control station 21.

In operation, when the isolation valve 130 is closed, a net upward force on the flapper 53 may push the flapper against the profile of the seat 124 and the seat upward toward the housing 131 until the seat engages the housing. The MCU 21*m* may monitor the strain gage 112*c* and determine the differential pressure across the flapper 53.

Alternatively, the strain gage 112*c* may be mounted on the flapper hinge 59.

Alternatively, the drilling system 1 may be a closed loop drilling system including a rotating control device, a supply flow meter, a returns flow meter, an automated choke, and/or a gas chromatograph. The closed loop drilling system may be operated to perform a mass balance during drilling and exert variable backpressure on the returns.

While the foregoing is directed to embodiments of the present disclosure, other and further embodiments of the disclosure may be devised without departing from the basic scope thereof, and the scope thereof is determined by the claims that follow.

The invention claimed is:

1. A differential pressure indicator (DPI), comprising:

a tubular mandrel for assembly as part of a casing string and for receiving a tubular string, the tubular mandrel includes a mandrel stop shoulder and a mandrel piston shoulder;

a tubular housing for assembly as part of the casing string and for receiving the tubular string, wherein a terminal end of the tubular mandrel fits into a terminal end of the tubular housing, the tubular housing movable relative to the tubular mandrel between an extended position and a retracted position, wherein the tubular housing includes a housing stop shoulder and a housing piston shoulder;

a hydraulic chamber formed between the housing piston shoulder and the mandrel piston shoulder; and a coupling in communication with the hydraulic chamber and for connection to a sensing line;

wherein the tubular housing is movable relative to the tubular mandrel and to the extended position in response to tension exerted on the tubular housing by the casing string, wherein a volume of the hydraulic chamber reduces in response to the movement of the tubular housing to the extended position.

2. The DPI of claim 1, wherein:

the coupling is a hydraulic coupling, and the DPI further comprises a hydraulic passage providing the communication between the hydraulic chamber and the hydraulic coupling.

3. The DPI of claim 2, wherein:

the hydraulic chamber is operable to move the tubular housing relative to the tubular mandrel and to the retracted position, the mandrel stop shoulder and housing stop shoulder are engaged in the retracted position, and the housing piston shoulder and mandrel piston shoulder are engaged in the extended position.

4. The DPI of claim 1, wherein the tubular housing is longitudinally movable relative to the tubular mandrel between the positions.

5. The DPI of claim 1, wherein:

each of the tubular mandrel and the tubular housing have a torsional coupling, and the torsional couplings are engaged in and between the positions.

6. The DPI of claim 5, wherein:

each of the tubular housing and the tubular mandrel includes a piston and an adapter fastened together, and the mandrel piston shoulder is formed in an outer surface of the mandrel piston, and the housing piston shoulder is formed in an inner surface of the housing piston.

7. The DPI of claim 6, wherein:

the mandrel stop shoulder is a lower end of the mandrel adapter, and the housing stop shoulder is formed in an inner surface of the housing piston.

8. The DPI of claim 6, wherein:

the housing torsional coupling is formed in a lower end of the housing piston, and the mandrel torsional coupling is formed in an outer surface of the mandrel piston.

9. The DPI of claim 6, wherein a hydraulic passage is formed in a wall of and along the housing piston.

10. A system for use in drilling a wellbore, comprising:

the DPI of claim 1; and an isolation valve, comprising:

a second tubular housing for connection to the tubular housing of the DPI;

a flapper disposed in the second tubular housing and pivotable relative thereto between an open position and a closed position; and a flow tube longitudinally movable relative to the second tubular housing for opening the flapper;

the sensing line for connecting the coupling of the DPI to a control station;

the control station comprising a microcontroller (MCU) operable to calculate a differential pressure across the flapper.

11. The system of claim 10, wherein:

when the flapper is in the open position, the DPI is configured to move from the extended position toward the retracted position when a hydraulic fluid in the hydraulic chamber is at a threshold pressure; and when the flapper is in the closed position, an upward force generated by the differential pressure across the flapper moves the DPI toward the retracted position, causing the pressure of the hydraulic fluid to decrease to an indication pressure;

wherein the MCU calculates the differential pressure across the flapper from the difference between the threshold pressure and the indication pressure.

12. The DPI of claim 1, wherein the DPI has a first length when the tubular housing is in the extended position and a second length when the tubular housing is in the retracted position, wherein the second length is less than the first length.

13. The DPI of claim 1, wherein the casing string is stretched by the DPI as the DPI moves from the extended position to the retracted position.

14. The DPI of claim 1, wherein the tubular housing is moveable relative to the tubular mandrel and to the retracted position in response to a fluid pressure in the hydraulic chamber, wherein the movement of the tubular housing to the retracted position increases the volume of the hydraulic chamber.

15. A method of constructing a wellbore, comprising:

deploying a tubular string into the wellbore through a casing string disposed in the wellbore, the casing string having an isolation valve in a closed position and a hydraulic sensing line extending along the casing string;

equalizing pressure across the isolation valve, including using the hydraulic sensing line to determine tension in the casing string to determine differential pressure across the isolation valve;

opening the isolation valve; and lowering the tubular string through the open isolation valve.

16. The method of claim 15, wherein the differential pressure is determined using pressure of the sensing line.

17. The method of claim 16, wherein:

the casing string further has a differential pressure indicator (DPI) connected to the hydraulic sensing line and the isolation valve, and the method further comprises, before equalization, injecting hydraulic fluid into the hydraulic sensing line, thereby retracting the DPI.

18. The method of claim 17, wherein the DPI is in an extended position before deployment of the tubular string.

19. The method of claim 17, wherein a stroke of the DPI decreases a length of the DPI.

20. The method of claim 17, wherein:

the casing string has a free portion and a portion cemented into the wellbore, and the isolation valve and the DPI are part of the free portion.

21. The method of claim 15, wherein the differential pressure is determined using fluid volume into or from the hydraulic sensing line.

22. The method of claim 15, wherein the casing string further has a control line extending therealong for opening the isolation valve.

23. The method of claim 15, further comprising monitoring the differential pressure during deployment of the tubular string.

24. An isolation valve for use in drilling a wellbore, comprising:

a tubular housing for assembly as part of a casing string and for receiving a drill string, wherein the tubular housing has a shoulder formed in an inner surface thereof;

a tubular member including a seat, wherein the tubular member and the seat are disposed in the tubular housing, and wherein the tubular member and the seat are longitudinally movable and longitudinally movable relative to the tubular housing, wherein the seat has a shoulder formed in an outer surface thereof;

a flapper pivotally connected to the seat between an open position and a closed position;

a flow tube longitudinally movable relative to the seat and the tubular housing for opening the flapper;

a first hydraulic chamber formed between the flow tube and the tubular housing and receiving a piston of the flow tube, wherein the flow tube is movable to open the flapper in response to a fluid pressure in the first hydraulic chamber;

a hydraulic passage in fluid communication with the first hydraulic chamber and a hydraulic coupling; and a differential pressure indicator (DPI) linked to the seat for responding to force exerted on the seat by the flapper in the closed position, the DPI including a second chamber formed between the shoulder of the tubular housing and the shoulder of the seat, wherein the second chamber is further formed between the tubular member and the tubular housing.

25. The valve of claim 24, wherein the second chamber is a second hydraulic chamber, and wherein a hydraulic passage disposed in the tubular housing extends from the second hydraulic chamber to a hydraulic coupling.

26. The valve of claim 25, wherein the DPI further comprises a compression spring disposed in the second hydraulic chamber of the DPI and having a first end bearing against the shoulder of the tubular housing and a second end bearing against the shoulder of the seat.

27. A system for use in drilling a wellbore, comprising:

the valve of claim 26; and a sensing line for connecting the hydraulic coupling of the DPI to a control station;

a control line for connecting the hydraulic coupling to a hydraulic manifold; and the control station for operating the hydraulic manifold and comprising a microcontroller (MCU) operable to calculate a differential pressure across the flapper by monitoring volume of hydraulic fluid into or from the sensing line.

28. A system for use in drilling a wellbore, comprising: valve of claim 26; and a sensing line for connecting the hydraulic coupling of the DPI to an accumulator of a control station, the control station further including a microprocessor operable to calculate a differential pressure across the flapper; and a level sensor in communication with the microprocessor, the level sensor configured to monitor a hydraulic fluid level in the accumulator.

29. A system for use in drilling a wellbore, comprising: the valve of claim 25; and a sensing line for connecting the hydraulic coupling of the DPI to a control station;

a control line for connecting the hydraulic coupling to a hydraulic manifold; and the control station for operating the hydraulic manifold and comprising a microcontroller (MCU) operable to calculate a differential pressure across the flapper using a pressure of the sensing line.

30. The valve of claim 24, wherein the DPI further comprises:

a compression spring disposed in the second chamber and having a first end bearing against the housing shoulder and a second end bearing against the seat shoulder;

a sensor for measuring a length of the spring; and leads extending from the sensor to an electrical coupling.

31. The valve of claim 30, wherein the sensor is a proximity sensor.

32. The valve of claim 30, wherein the sensor is a position sensor.

* * * * *